US009546343B2

(12) United States Patent
Meier et al.

(10) Patent No.: US 9,546,343 B2
(45) **Date of Patent: *Jan. 17, 2017**

(54) LOW-WATER, LIQUID DETERGENT HAVING INCREASED FAT-DISSOLVING POWER

(71) Applicant: Henkel AG & Co. KGaA, Dusseldorf (DE)

(72) Inventors: Frank Meier, Duesseldorf (DE); Annika Gueldner, Duesseldorf (DE); Sabine Schuemann, Neuss (DE); Luca Bellomi, Duesseldorf (DE); Matthias Sunder, Duesseldorf (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/374,258

(22) PCT Filed: Jan. 25, 2013

(86) PCT No.: PCT/EP2013/051483

§ 371 (c)(1),
(2) Date: Jul. 24, 2014

(87) PCT Pub. No.: WO2013/113635

PCT Pub. Date: Aug. 8, 2013

(65) Prior Publication Data

US 2015/0031593 A1 Jan. 29, 2015

(30) Foreign Application Priority Data

Feb. 2, 2012 (DE) ..... 10 2012 201 502

(51) Int. Cl.

| | |
|---|---|
| ***C11D 1/02*** | (2006.01) |
| ***C11D 1/72*** | (2006.01) |
| ***C11D 1/83*** | (2006.01) |
| ***C11D 1/14*** | (2006.01) |
| ***C11D 1/04*** | (2006.01) |
| ***C11D 1/22*** | (2006.01) |
| ***C11D 3/30*** | (2006.01) |
| ***C11D 17/04*** | (2006.01) |
| ***B08B 3/08*** | (2006.01) |
| ***C11D 1/10*** | (2006.01) |
| ***C11D 3/20*** | (2006.01) |
| ***C11D 17/08*** | (2006.01) |

(52) U.S. Cl.

CPC . *C11D 1/14* (2013.01); *B08B 3/08* (2013.01); *C11D 1/04* (2013.01); *C11D 1/10* (2013.01); *C11D 1/143* (2013.01); *C11D 1/22* (2013.01); *C11D 1/72* (2013.01); *C11D 1/83* (2013.01); *C11D 3/2065* (2013.01); *C11D 3/30* (2013.01); *C11D 17/043* (2013.01); *C11D 17/08* (2013.01)

(58) Field of Classification Search

CPC ..... C11D 1/02; C11D 1/72; C11D 1/83
USPC ..... 510/360, 421, 426, 499
See application file for complete search history.

(56) References Cited

U.S. PATENT DOCUMENTS

| | | | | |
|---|---|---|---|---|
| 4,416,793 A * | 11/1983 | Barrat et al. | ..... | 510/335 |
| 6,258,295 B1 * | 7/2001 | Wehlage et al. | ..... | 252/186.29 |

FOREIGN PATENT DOCUMENTS

| | | | | |
|---|---|---|---|---|
| EP | 1120459 A1 | 8/2001 | | |
| EP | 1354939 | * 10/2003 | ..... | C11D 17/04 |
| EP | 1516917 A1 | 3/2005 | | |
| EP | 1854869 A1 | 11/2007 | | |
| EP | 2441824 A1 | 4/2012 | | |
| WO | 0179416 A1 | 10/2001 | | |
| WO | 03089563 A2 | 10/2003 | | |
| WO | WO 2008/110205 | * 9/2008 | ..... | C11D 1/83 |
| WO | 2011117079 A1 | 9/2011 | | |

OTHER PUBLICATIONS

ISA European Patent Office, International Search Report for International Application No. PCT/EP2013/051483, dated Jun. 4, 2013.
"Dr. Z Presents All About Fatty Alcohols", Condea, 2000.
Burnley et al., "Modified Oxo Alcohol Derivatives for Personal Care", 6th World Surfactants Congress: CESIO 2004.
Noweck, "Production, Technologies and Applications of Fatty Alcohols", 4th Workshop on Fats and Oils as Renewable Feedstock for the Chemical Industry, 2011.

* cited by examiner

*Primary Examiner* — Brian P Mruk
(74) *Attorney, Agent, or Firm* — P. Scott Smith

(57) ABSTRACT

The invention relates to a liquid detergent or cleaning agent, comprising a) an anionic surfactant neutralized with an amine, b) an alkoxylated oxo alcohol having 7 or 8 alkoxy units, and c) up to 10 wt. %, relative to the entire detergent or cleaning agent, of water. The liquid detergent or cleaning agent has very good cleaning performance toward soiling containing fat and can be a component of water-soluble packagings.

8 Claims, No Drawings

LOW-WATER, LIQUID DETERGENT HAVING INCREASED FAT-DISSOLVING POWER

CROSS-REFERENCE TO RELATED APPLICATION

This application is a U.S. National-Stage entry under 35 U.S.C. §371 based on International Application No. PCT/EP2013/051483, filed Jan. 25, 2013, which was published under PCT Article 21(2) and which claims priority to German Application No. 10 2012 201 502.7, filed Feb. 2, 2012, which are all hereby incorporated in their entirety by reference.

TECHNICAL FIELD

The technical field relates to a liquid washing or cleaning agent with anionic and nonionic surfactants. The technical field also relates to a water-soluble package comprising a liquid washing or cleaning agent of this type.

BACKGROUND

It is increasingly often the case that delicate textiles, such as for example silk or microfibers, are processed into garments that can only be washed at 30 or 40° C. Furthermore, energy-saving washing at low washing temperatures is becoming a trend. However, the performance of washing agents on fat-containing soils declines as washing temperatures are lowered. A pretreatment of fat-containing soils is regarded as inconvenient by many consumers.

To increase the cleaning performance, in WO 2011/117079 A1, for example, the use of liquid, hydrophobic compounds in combination with unsaturated fatty acid (soap)s is proposed.

However, the need still exists to improve the cleaning performance of washing or cleaning agents, in particular on fat-containing soils.

Washing or cleaning agents are available to the consumer today in a wide variety of presentations. In addition to powders and granules, this range also comprises e.g. liquids, gels or single-dose packages (tablets or filled bags).

In particular, single-dose packages with liquid washing or cleaning agents are becoming increasingly popular; on the one hand they meet the consumer's desire for simplified dosing and on the other hand, more and more consumers prefer liquid washing or cleaning agents.

In the formulation of liquid washing or cleaning agents for packaging in water-soluble bags, it must be ensured in particular that the ingredients of the washing or cleaning agent do not already dissolve or partially dissolve the water-soluble envelope of the bag before it is used, thus leading to undesirable leakages.

Accordingly, it is at least one object herein to provide a liquid washing or cleaning agent with increased cleaning performance, in particular on fat-containing soils, which is also suitable for packaging in a water-soluble envelope. Furthermore, other desirable features and characteristics of the present invention will become apparent from the subsequent detailed description of the invention and the appended claims, taken in conjunction with the accompanying drawings and this background of the invention.

SUMMARY

In accordance with an exemplary embodiment, a liquid washing or cleaning agent comprises: an anionic surfactant neutralized with an amine; an alkoxylated oxo alcohol with 7 or 8 alkoxy units; and up to about 10 wt. % water, based on the total washing or cleaning agent.

In accordance with another exemplary embodiment, a water-soluble package contains a liquid washing or cleaning agent and a water-soluble envelope. The liquid washing or cleaning agent comprises: an anionic surfactant neutralized with an amine; an alkoxylated oxo alcohol with 7 or 8 alkoxy units; and up to about 10 wt. % water, based on the total washing or cleaning agent.

In accordance with a further exemplary embodiment, a method of cleaning a fat-containing soil from a cloth comprises applying a washing or cleaning agent to the soil on the cloth. The washing or cleaning agent comprises an anionic surfactant neutralized with an amine; an alkoxylated oxo alcohol with 7 or 8 alkoxy units; and up to about 10 wt. % water, based on the total washing or cleaning agent.

DETAILED DESCRIPTION

In an exemplary embodiment, a liquid washing or cleaning agent comprises:

a) an anionic surfactant neutralized with an amine, b) an alkoxylated oxo alcohol with 7 or 8 alkoxy units and c) up to about 10 wt. % water, based on the total washing or cleaning agent.

Surprisingly, it has been shown that the use of oxo alcohols with 7 or 8 alkoxy units as nonionic surfactants leads to liquid washing or cleaning agents with increased cleaning performance, in particular on fat-containing soils.

In an exemplary embodiment, the amine is chosen from choline, triethylamine, monoethanolamine, diethanolamine, triethanolamine, methylethylamine and mixtures thereof.

Neutralization with amines, unlike bases such as NaOH or KOH, does not lead to the formation of water. Thus, low-water washing or cleaning agents can be produced that are directly suitable for use in water-soluble bags.

In one embodiment, the neutralized anionic surfactant is chosen from neutralized alkylbenzenesulfonic acids, neutralized olefin sulfonic acids, neutralized C12-18 alkanesulfonic acids, neutralized sulfuric acid monoesters with fatty alcohols, neutralized fatty acids, neutralized sulfuric acid monoesters with ethoxylated fatty alcohols and mixtures thereof. These neutralized anionic surfactants exhibit a high cleaning performance on a large number of soils.

A particularly high cleaning performance on fat-containing soils is obtained with the use of C13-15 oxo alcohols with 7 EO, C13-15 oxo alcohols with 8 EO and mixtures thereof in the liquid washing or cleaning agents.

Another exemplary embodiment includes a water-soluble package, which contains a liquid washing or cleaning agent and a water-soluble envelope, wherein the liquid washing or cleaning agent contains a) an anionic surfactant neutralized with an amine, b) an alkoxylated oxo alcohol with 7 or 8 alkoxy units and c) up to about 10 wt. % water, based on the total washing or cleaning agent.

In an embodiment, the water-soluble envelope contains polyvinyl alcohol or a polyvinyl alcohol copolymer. Water-soluble envelopes containing polyvinyl alcohol or a polyvinyl alcohol copolymer exhibit good stability with sufficiently high water solubility, in particular cold-water solubility.

Also provided herein is the use of a combination of anionic surfactant neutralized with an amine and an alkoxylated oxo alcohol with 7 or 8 alkoxy units in a liquid washing or cleaning agent, which contains up to about 10 wt. % water, based on the total washing or cleaning agent, to increase the cleaning performance on fat-containing soils.

In an exemplary embodiment, the liquid washing or cleaning agent contains an anionic surfactant neutralized with an amine and an alkoxylated oxo alcohol with 7 or 8 alkoxy units.

In another embodiment, the anionic surfactant neutralized with an amine is a neutralized alkylbenzenesulfonic acid, a neutralized olefin sulfonic acid, a neutralized C12-18 alkanesulfonic acid, a neutralized sulfuric acid monoester with a fatty alcohol, a neutralized fatty acid, a neutralized sulfuric acid monoester with an ethoxylated fatty alcohol or a mixture of two or more of these neutralized anionic surfactants. Among these neutralized anionic surfactants, neutralized alkylbenzenesulfonic acids, neutralized fatty acids and mixtures thereof are particularly suitable.

The content of anionic surfactant neutralized with amine is, for example, about 10 to about 50 wt. %, such as, about 15 to about 40 wt. %, based in each case on the total liquid washing or cleaning agent.

As surfactants of the sulfonate type, preferably C9-13 alkylbenzenesulfonates or mixtures of alkene- and hydroxy-alkanesulfonates and disulfonates, as obtained, e.g., from C12-18 monoolefins with a terminal or internal double bond by sulfonating with gaseous sulfur trioxide and subsequent alkaline or acidic hydrolysis of the sulfonation products, are suitable. Also suitable are the esters of α-sulfo fatty acids (ester sulfonates), for example the α-sulfonated methyl esters of hydrogenated coconut, palm kernel or tallow fatty acids.

As alk(en)yl sulfates, the salts of the sulfuric acid semiesters of C12-C18 fatty alcohols, e.g., from coconut fatty alcohol, tallow fatty alcohol, lauryl, myristyl, cetyl or stearyl alcohol or the C10-C20 oxo alcohols and those semiesters of secondary alcohols of these chain lengths are suitable. For technical reasons relating to washing, the C12-C16 alkyl sulfates and C12-C15 alkyl sulfates, as well as C14-C15 alkyl sulfates, are suitable. 2,3-Alkyl sulfates are also suitable anionic surfactants.

Fatty alcohol ether sulfates, such as the sulfuric acid monoesters of the straight-chained or branched C7-21 alcohols ethoxylated with 1 to 6 moles of ethylene oxide, such as 2-methyl-branched C9-11 alcohols with on average 3.5 moles of ethylene oxide (EO) or C12-18 fatty alcohols with 1 to 4 EO, are suitable.

Other suitable anionic surfactants are soaps. Saturated and unsaturated fatty acid soaps, such as the salts of lauric acid, myristic acid, palmitic acid, stearic acid, (hydrogenated) erucic acid and behenic acid, are suitable, as well as in particular soap mixtures derived from natural fatty acids, for example coconut oil, palm kernel oil, olive oil or tallow fatty acids.

The anionic surfactants are present in the form of ammonium salts. The amine used for neutralization is, for example, choline, triethylamine, monoethanolamine, diethanolamine, triethanolamine, methylethylamine or a mixture thereof, with monoethanolamine being particularly suitable.

In an exemplary embodiment, the liquid washing or cleaning agent contains an alkylbenzenesulfonic acid, in particular C9-13 alkylbenzenesulfonic acid, neutralized with monoethanolamine and/or a fatty acid neutralized with monoethanolamine.

In addition to the anionic surfactant neutralized with amine, the liquid washing or cleaning agents contain an alkoxylated oxo alcohol with 7 or 8 alkoxy units. Oxo alcohols are primary, in some cases branched, higher alcohols, which are obtained during oxo synthesis. In this process, oxo aldehydes or primary aldol condensation products thereof are converted to the corresponding oxo alcohols by catalytic hydrogenation.

A C13-15 oxo alcohol with 7 EO, a C13-15 oxo alcohol with 8 EO or a mixture of these two oxo alcohols is suitably employed in the liquid washing or cleaning agents, the use of a C13-15 oxo alcohol with 8 EO being particularly suitable.

The content of alkoxylated oxo alcohol with 7 or 8 alkoxy units is, for example, about 5 to about 35 wt. %, such as about 10 to about 25 wt. %, based in each case on the total liquid washing or cleaning agent.

In addition to the alkoxylated oxo alcohol with 7 or 8 alkoxy units, the liquid washing or cleaning agent can contain further nonionic surfactants. Suitable nonionic surfactants include alkoxylated fatty alcohols, alkoxylated fatty acid alkyl esters, fatty acid amides, alkoxylated fatty acid amides, polyhydroxy fatty acid amides, alkylphenol polyglycol ethers, amine oxides, alkyl polyglucosides and mixtures thereof.

As alkoxylated fatty alcohols, preferably ethoxylated, in particular primary alcohols with preferably 8 to 18 C atoms and on average 4 to 12 moles of ethylene oxide (EO) per mole of alcohol are employed, in which the alcohol residue is linear. In particular, alcohol ethoxylates with 12 to 18 C atoms, for example from coconut alcohol, palm alcohol, tallow fatty alcohol or oleyl alcohol, and on average 5 to 8 EO per mole of alcohol, are suitable. The preferred ethoxylated alcohols include e.g. C12-14 alcohols with 4 EO or 7 EO, C9-11 alcohol with 7 EO, C12-18 alcohols with 5 EO or 7 EO and mixtures thereof. The degrees of ethoxylation stated represent statistical averages, which for a specific product can be a whole or a fractional number. Preferred alcohol ethoxylates have a narrow homolog distribution (narrow range ethoxylates, NRE). In addition to these nonionic surfactants, fatty alcohols with more than 12 EO can also be employed. Examples of these are tallow fatty alcohol with 14 EO, 25 EO, 30 EO or 40 EO. Nonionic surfactants containing EO and PO groups together in the molecule can also be employed. Furthermore, a mixture of a (relatively strongly) branched ethoxylated fatty alcohol and an unbranched ethoxylated fatty alcohol, such as e.g. a mixture of a C16-18 fatty alcohol with 7 EO and 2-propylheptanol with 7 EO, is also suitable. The quantity of further nonionic surfactants is, for example, less than about 5 wt. %, for example, less than about 2 wt. %, such as less than about 1 wt. %, based in each case on the total quantity of liquid washing or cleaning agent.

The total quantity of anionic surfactant neutralized with an amine and an alkoxylated oxo alcohol with 7 or 8 alkoxy units in the liquid washing or cleaning agent is up to about 85 wt. %, for example about 40 to about 75 wt. %, such as about 50 to about 70 wt. %, based on the total liquid washing or cleaning agent.

The washing or cleaning agents are liquid. The washing or cleaning agents can contain water, in which case the content of water is less than about 10 wt. %, for example, less than about 8 wt. %, based in each case on the total washing or cleaning agent.

In addition to the anionic surfactant neutralized with an amine and an alkoxylated oxo alcohol with 7 or 8 alkoxy units, the washing or cleaning agent can contain further ingredients that further improve the application properties and/or the aesthetic properties of the washing or cleaning agent. In an exemplary embodiment, the washing or cleaning agent additionally contains one or more substances from the group of the builders, bleaching agents, enzymes, electrolytes, pH adjusting agents, perfumes, perfume carriers, fluorescent agents, dyes, hydrotropes, foam inhibitors, silicone oils, antiredeposition agents, anti-grays, shrinkage preventers, anti-wrinkle agents, dye transfer inhibitors, antimicrobial active substances, non-aqueous solvents, germicides, fungicides, antioxidants, preservatives, opacifiers, corrosion inhibitors, antistatic agents, bittering agents, ironing aids, proofing and impregnating agents, skincare active substances, swelling and anti-slip agents, softening components and UV absorbers.

The liquid washing or cleaning agent can be filled into a water-soluble envelope and can thus be a constituent of a water-soluble package.

A water-soluble package contains, in addition to the liquid washing or cleaning agent, a water-soluble envelope. The water-soluble envelope is, for example, formed by a water-soluble film material.

These water-soluble packages can be produced either by vertical form fill seal (VFFS) methods or by thermoforming methods.

The thermoforming method generally includes forming a first layer from a water-soluble film material to create convexities for receiving a composition therein, filling the composition into the convexities, covering the convexities filled with the composition with a second layer of a water-soluble film material and sealing the first and second layers together at least around the convexities.

The water-soluble envelope, for example, is made from a water-soluble film material chosen from polymers or polymer mixtures. The envelope can be made of one layer or of two or more layers of the water-soluble film material. The water-soluble film material of the first layer and of the other layers, if present, can be the same or different.

The water-soluble package comprising the liquid washing or cleaning agent and the water-soluble envelope can have one or more chambers. The liquid washing or cleaning agent can be contained in one or more chambers, if present, of the water-soluble envelope. In an embodiment, the water-soluble package has two chambers. In this regard, the first chamber contains the liquid washing or cleaning agent and the second chamber contains a solid or liquid agent.

The water-soluble packages with one chamber can have a substantially dimensionally stable spherical and pillow-shaped configuration with a circular, elliptical, square or rectangular basic form.

In a water-soluble package with one chamber, the quantity of liquid washing or cleaning agent is, for example, the full or half dose required for a wash cycle. In a water-soluble package with multiple chambers, the quantity of total washing or cleaning agent is, for example, the full or half dose required for a wash cycle.

In another embodiment, the water-soluble envelope contains polyvinyl alcohol or a polyvinyl alcohol copolymer.

Suitable water-soluble films for producing the water-soluble envelope, for example, are based on a polyvinyl alcohol or a polyvinyl alcohol copolymer, the molecular weight of which is in the range of from about 10,000 to about 1,000,000 gmol-1, for example of from about 20,000 to about 500,000 gmol-1, for example of from about 30,000 to about 100,000 gmol-1, such as of from about 40,000 to about 80,000 gmol-1.

The production of polyvinyl alcohol generally takes place by hydrolysis of polyvinyl acetate, since the direct synthesis route is not possible. The same applies to polyvinyl alcohol copolymers, which are produced from corresponding polyvinyl acetate copolymers. In an embodiment, at least one layer of the water-soluble envelope comprises a polyvinyl alcohol of which the degree of hydrolysis is about 70 to about 100 mole %, for example, about 80 to about 90 mole %, for example about 81 to about 89 mole %, such as about 82 to about 88 mole %.

It is additionally possible to add a polymer that is selected from the group comprising acrylic acid-containing polymers, polyacrylamides, oxazoline polymers, polystyrene sulfonates, polyurethanes, polyesters, polyether polylactic acid or mixtures of the above polymers, to a film material that is suitable for producing the water-soluble envelope.

Exemplary polyvinyl alcohol copolymers comprise dicarboxylic acids as further monomers in addition to vinyl alcohol. Suitable dicarboxylic acids are itaconic acid, malonic acid, succinic acid and mixtures thereof, with itaconic acid being preferred.

Likewise exemplary polyvinyl alcohol copolymers comprise an ethylenically unsaturated carboxylic acid, salt thereof or ester thereof in addition to vinyl alcohol. In an embodiment, these polyvinyl alcohol copolymers contain acrylic acid, methacrylic acid, acrylic acid ester, methacrylic acid ester or mixtures thereof in addition to vinyl alcohol.

Suitable water-soluble films for use in the envelopes of the water-soluble packages contemplated herein are films that are marketed by MonoSol LLC, e.g. with the name M8630, C8400 or M8900. Other suitable films include films with the name Solublon® PT, Solublon® GA, Solublon® KC or Solublon® KL from Aicello Chemical Europe GmbH or the VF-HP films from Kuraray.

EXAMPLE

Liquid washing or cleaning agents were produced by conventional and known methods and processes. In the following Table 1, the compositions of two washing or cleaning agents as contemplated herein, E1 and E2, and two washing or cleaning agents according to prior art, V1 and V2, are shown.

TABLE 1

Liquid washing or cleaning agents E1 and E2, and V1 and V2 [all quantities are given in wt. % of active substance, based on the composition]

| Ingredients | E1 | E2 | V1 | V2 |
|---|---|---|---|---|
| $C_{10}$-$C_{13}$ alkylbenzenesulfonic acid | 21 | 21 | 21 | 21 |
| $C_{13}$-$C_{15}$ oxo alcohol with 8 EO | 22.5 | — | — | — |
| $C_{13}$-$C_{15}$ oxo alcohol with 7 EO | — | 22.5 | — | — |
| $C_{12-18}$ fatty alcohol with 7 EO | — | — | 22.5 | — |
| $C_{12-18}$ fatty alcohol with 3 EO | — | — | — | 22.5 |
| $C_{12-18}$ fatty acid | 17.5 | 17.5 | 17.5 | 17.5 |
| Glycerol | 13 | 13 | 13 | 13 |
| 1,2-Propanediol | 13.5 | 13.5 | 13.5 | 13.5 |
| Ethanol | 3.26 | 3.26 | 3.26 | 3.26 |
| Phosphonate | 0.3 | 0.3 | 0.3 | 0.3 |
| Monoethanolamine | 6.4 | 6.4 | 6.4 | 6.4 |
| Dyes, enzymes (cellulase, amylase & protease), optical brightener, perfume | 0.8 | 0.8 | 0.8 | 0.8 |
| Water | 1.74 | 1.74 | 1.74 | 1.74 |

To determine the cleaning performance, various fat-containing soils with a diameter of approx. 2 cm each were applied onto various cloths (polyester or cotton).

A domestic washing machine (Miele W 526) was then loaded with 3.5 kg of ballast laundry together with the soiled cloths. In addition, 35 g of the washing agent to be tested (E1, E2, V1 or V2) were metered in and washing was carried out at 40° C. After hanging the cloths to dry and mangling them, their remission was determined spectrophotometrically (Minolta CR200-1) (cf. Table 2). The stain removal was evaluated by means of the Y value.

TABLE 2

| Degrees of whiteness (averages of 6 determinations) | | | | |
|---|---|---|---|---|
| | E1 | E2 | V1 | V2 |
| Used frying fat/Ctn. | 61.7 | 62.4 | 60.4 | 55.2 |
| Lipstick no. 453 (L'Oreal)/Ctn. | 46.2 | 44.4 | 44.1 | 33.3 |
| Lipstick no. 83 (Jade)/Ctn. | 45.1 | 43.8 | 42.6 | 32.7 |
| Make up no. 40 (Sans Soucis)/Ctn. | 53.3 | 51.4 | 48.1 | 32.7 |
| Make up no. 45 (Jade)/Ctn. | 41.5 | 41.4 | 40.3 | 37.3 |
| Used lard/PE | 68.2 | 67.3 | 64.7 | 57.6 |
| Lipstick no. 83 (Jade)/PE | 59.1 | 58.8 | 57.4 | 41.1 |

Ctn. = cotton, PE = polyester

The results clearly show that liquid washing or cleaning agents with alkoxylated oxo alcohols exhibit higher cleaning performance on fat-containing soils.

For the production of water-soluble packages with the washing or cleaning agents E1 and E2, a film of the M 8630 type (ex Monosol) with a thickness of 76 μm was drawn into a depression by means of a vacuum to form a convexity. The convexity was then filled with 30 ml of one of the liquid washing or cleaning agents E1 or E2. After covering the convexities filled with the agent using a second layer of a film of the M 8630 type, the first and second layers were sealed together. The sealing temperature was 150° C. and the sealing period 1.1 seconds.

After a 4, 8 and 12 weeks' storage period of the water-soluble packages with the washing or cleaning agents E1 or E2 under different climatic conditions, no dissolution or partial dissolution of the water-soluble envelope could be observed whatsoever. Moreover, no pores or holes, which would likewise lead to product discharge or leakages, could be found.

Water-soluble packages with the washing or cleaning agents E1 and E2 dissolved in wash cycles at temperatures in the range of 20 to 95° C. leaving no residue and displayed very good cleaning performance, in particular on fat-containing soils.

The invention claimed is:

1. A liquid washing or cleaning agent comprising:

a) an anionic surfactant neutralized with an amine;

b) an alkoxylated oxo alcohol with 8 alkoxy units; and c) up to about 10 wt. % water, based on the total washing or cleaning agent wherein the washing or cleaning agent is packaged in a water-soluble covering.

2. The liquid washing or cleaning agent according to claim 1, wherein the amine is chosen from choline, triethylamine, monoethanolamine, diethanolamine, triethanolamine, methylethylamine and mixtures thereof.

3. The liquid washing or cleaning agent according to claim 1, wherein the anionic surfactant neutralized with an amine is chosen from neutralized alkylbenzenesulfonic acids, neutralized olefin sulfonic acids, neutralized $C_{12-18}$ alkanesulfonic acids, neutralized sulfuric acid monoesters with fatty alcohols, neutralized fatty acids, neutralized sulfuric acid monoesters with ethoxylated fatty alcohols and mixtures thereof.

4. The liquid washing or cleaning agent according to claim 1, wherein the anionic surfactant neutralized with an amine is chosen form alkylbenzenesulfonic acids neutralized with monoethanolamine, fatty acids neutralized with monoethanolamine and mixtures thereof.

5. The liquid washing or cleaning agent according to claim 1, wherein the alkoxylated oxo alcohol is $C_{13-15}$ oxo alcohols with 8 EO and mixtures thereof.

6. A water-soluble package containing a liquid washing or cleaning agent and a water-soluble envelope, wherein the liquid washing or cleaning agent comprises:

a) an anionic surfactant neutralized with an amine;

b) an alkoxylated oxo alcohol with 8 alkoxy units; and c) up to about 10 wt. % water, based on the total washing or cleaning agent.

7. The water-soluble package according to claim 6, wherein the water-soluble envelope comprises polyvinyl alcohol or a polyvinyl alcohol copolymer.

8. A method of cleaning a fat-containing soil from a cloth, the method comprising the step of applying a washing or cleaning agent to the soil on the cloth, the washing or cleaning agent comprising:

a) an anionic surfactant neutralized with an amine;

b) an alkoxylated oxo alcohol with 8 alkoxy units; and c) up to about 10 wt. % water, based on the total washing or cleaning agent wherein the washing or cleaning agent is packaged in a water-soluble covering.

* * * * *